US008276350B2

(12) United States Patent
Bouzas et al.

(10) Patent No.: US 8,276,350 B2
(45) Date of Patent: Oct. 2, 2012

(54) METHOD OF WRAPPING A FRAGRANCE DETECTABLE SOAP BAR

(75) Inventors: Camilo Bouzas, Mexico City (MX); Todd VanGordon, Basking Ridge, NJ (US)

(73) Assignee: Colgate-Palmolive Company, New York, NY (US)

( * ) Notice: Subject to any disclaimer, the term of this patent is extended or adjusted under 35 U.S.C. 154(b) by 1234 days.

(21) Appl. No.: 11/077,721

(22) Filed: Mar. 11, 2005

(65) Prior Publication Data

US 2005/0192192 A1 Sep. 1, 2005

Related U.S. Application Data

(63) Continuation-in-part of application No. PCT/US2004/016234, filed on May 21, 2004.

(60) Provisional application No. 60/473,053, filed on May 23, 2003.

(51) Int. Cl.
*B65B 11/12* (2006.01)

(52) U.S. Cl. ..... 53/461; 53/141; 53/389.3; 206/77.1; 510/140; 510/439

(58) Field of Classification Search ..... 53/141; 206/77.1; 510/410, 439, 140; 40/635
See application file for complete search history.

(56) References Cited

U.S. PATENT DOCUMENTS 549,371 A * 11/1895 Kirk ..... 510/140
1,468,626 A 9/1923 Brownell
1,657,391 A * 1/1928 Haney ..... 510/439
2,155,668 A * 4/1939 Little ..... 510/439
3,008,280 A 11/1961 Barkman
3,019,573 A * 2/1962 Navikas ..... 53/399
3,073,436 A * 1/1963 Burt ..... 206/77.1
3,977,159 A 8/1976 Seragnoli
4,277,024 A * 7/1981 Spector ..... 239/36
4,314,142 A * 2/1982 Brown et al. ..... 219/384
4,447,709 A * 5/1984 Whitman, III ..... 219/384
4,653,225 A * 3/1987 Spector ..... 47/84
4,659,495 A * 4/1987 Figliola ..... 510/140
4,696,844 A * 9/1987 Spector ..... 428/46
4,726,171 A * 2/1988 Kreager et al. ..... 53/410

(Continued)

FOREIGN PATENT DOCUMENTS

CH 238603 11/1945

(Continued)

*Primary Examiner* — Stephen F Gerrity
(74) *Attorney, Agent, or Firm* — Judy W. Chung

(57) ABSTRACT

Methods for placing apertures in a film material wrapping of soap bars so that the soap bar fragrance can be readily detected outside of the packaged soap bar. The apertures can be shaped apertures or slit apertures. The apertures can be placed in the film material at the time of the decoration of the film material or at the time of feeding the film material to be placed around the soap bar. The apertures can be any surface of the wrapped soap bar, but should be of an overall surface area to emit not more than 60% of the fragrance or 50% of the moisture content of the soap bar over a period of 6 months. In addition the surface of the film material adjacent the soap bar may contain a coating of the fragrance of the soap bar, or in the alternative the surface of an inner insert material such as a stiffener can contain a coating of the fragrance of the soap bar. Further the apertures can be coordinated with the decoration and when the decoration is a botanical the fragrance of the soap bar and that of the botanical can be coordinated.

18 Claims, 5 Drawing Sheets

U.S. PATENT DOCUMENTS

| | | | | | |
|---|---|---|---|---|---|
| 4,765,120 | A * | 8/1988 | Phillips | 53/441 |
| 4,824,707 | A * | 4/1989 | Spector | 428/46 |
| 5,307,609 | A * | 5/1994 | Kurata et al. | 53/556 |
| 5,569,511 | A * | 10/1996 | Spector | 428/11 |
| 6,095,959 | A * | 8/2000 | Negrini et al. | 493/58 |
| 6,382,418 | B1 * | 5/2002 | Weder | 206/423 |
| 7,172,065 | B2 * | 2/2007 | Prater | 206/5 |
| 2004/0050741 | A1 * | 3/2004 | Prater | 206/497 |
| 2004/0248750 | A1 * | 12/2004 | Nimmey et al. | 510/141 |

FOREIGN PATENT DOCUMENTS

| | | | |
|---|---|---|---|
| EP | 0 550 406 | B1 | 9/1996 |
| GB | 1 442 369 | A | 7/1976 |
| GB | 1 593 653 | A | 7/1981 |
| WO | WO 2004113061 | A1 * | 12/2004 |

* cited by examiner

METHOD OF WRAPPING A FRAGRANCE DETECTABLE SOAP BAR

This application is a continuation-in-part of application PCT/US2004/016234, filed May 21, 2004 which is a priority filing of Provisional Application U.S. 60/473,053 filed May 23, 2003.

This invention relates to a wrapped soap bar where the fragrance of the soap can be detected outside of the wrapped soap bar. More particularly this invention relates to wrapping soap bars with a film that contains apertures for the detection of the soap bar fragrance at the point of purchase.

BACKGROUND OF THE INVENTION

The fragrance is very important to the purchasers of soap bars. The customer wants to know the fragrance of the soap bar prior to purchase. When packaged in paperboard cartons, a paper wrapper or loosely packaged in a plastic wrap some of the fragrance will escape the package. However, in more tightly packaged soap bars in plastic materials very little of the fragrance will escape the package. In order to be detected effectively for a purchase decision, more of the fragrance needs to be available to the purchaser. This has been done by "fragrance releasing" attachments to the exterior of the package. The fragrance releasing attachments are effective but add to the cost of the package. An overall objective is to provide the purchaser with sufficient information about the fragrance of the soap bar without any significant increase in finished product cost.

This has been done through a coordination of the soap bar and the package. The package is designed to emit an amount of fragrance during a given period of time. The soap bar formula is adjusted to contain a sufficient amount of fragrance for this given period of time and to have a sufficient amount of fragrance remaining for satisfaction of the user during use of the soap bar.

BRIEF DESCRIPTION OF THE INVENTION

The invention is directed to a packaged soap bar where the soap bar will emit some fragrance through the package and the methods of making this package.

The soap bar is wrapped in a film material that has a plurality of apertures in the form of shaped openings or slits. Shaped openings have a geometric shape such as a circular, elliptical, triangular, quadrangular or other polygonal shape as well as the shape of a manufactured or natural article. The soap bar has a specified amount of fragrance. The wrapped soap bar has a top surface, bottom surface, side surfaces and end surfaces. The apertures are on one or more of these surfaces. These are apertures of a calculated overall surface area per soap bar to allow some of the soap bar fragrance to be emitted from the package. The overall surface area of shaped opening apertures is about 50 sq. mm to about 1000 sq. mm, and preferably about 100 sq. mm to about 750 sq. mm. When the apertures are slits these will be of a combined overall length of about 10 mm to about 300 mm, and preferably about 30 mm to about 240 mm. The surface area of apertures and the length of slits will depend to a degree on size of the soap bar and consequently the size of the soap bar. The apertures, both shaped openings and slit openings in the film material, are of an overall surface area or length so that the soap bar retains at least about than about 40% to about 90%, preferably about 50% to about 80%, of the soap bar fragrance over a period of six months.

Optionally, in addition the inner surface of the film material wrapper can have a fragrance coating of the soap bar fragrance, or an additional package structural insert, such as a stiffener, can have a fragrance coating of the soap bar fragrance on a surface to enhance the amount of fragrance that can be emitted. Further, after the manufacture of the soap bar the soap bar can be over-sprayed with some of the fragrance of the soap bar prior to packaging. Using these techniques the amount of fragrance emitted over a period of time is enhanced. When the wrapper film material or a stiffener has a full or partial coating, less of the soap bar fragrance will have to be emitted so that it can be detected by the user at the time of purchase.

The film material can be of any plastic or plastic laminate that is substantially impervious to the fragrance of the soap bar. A plastic laminate may be made with paper and have several layers in the laminate. The plastics include polyethylenes, polypropylenes, vinyl plastics including polyvinyl chlorides, urethane plastics and polyesters. The paper used in a laminate can be coated or uncoated with an adhesive or an additive. A stiffener can be of any of these same materials as well as being solely paperboard.

The soap bars are packaged using a film material that has apertures made off-line at the time that a sheet of film material is to be printed with a decoration and product information, or subsequently in-line when the rolls of film material have been formed and are to be used to package soap bars. In the in-line techniques the film material has been printed with a decoration and product information in a prior operation. In the off-line techniques the apertures are formed during wrapper roll stock production.

In either process a film material with the apertures is fed into the soap bar wrapping section of the wrapping equipment. Typically the soap bar is fed into a packaging machine and the film material is fed down onto the soap bar. The length of film material needed is cut. The leading edge of the film material is tucked under the bar and the trailing edge then tucked under the soap bar overlapping the leading edge. The side film material is then folded in and the sides and lower overlapping edges sealed. When a stiffener sheet is to be included in the package it is fed into the wrapping equipment at the same time as the wrapper film, cut to length, and wrapped around the soap bar with the wrapper film. It is not sealed and is open at the ends. It is held in place by the wrapper film.

In either process the product is a wrapped soap bar with apertures of a predetermined, number, size and placement. When the soap bars are to be sold in multi-packs the film of the multi-pack will have apertures, shaped or slit, to have the fragrance that flows through the package of each soap bar flow to the exterior of the multi-pack.

DETAILED DESCRIPTION OF THE INVENTION

The invention will be described in more detail with reference to the drawings. The invention will be described in its preferred embodiments with the understanding that the inventive concept can be modified but yet embody the essence of the present invention.

Figure 1:
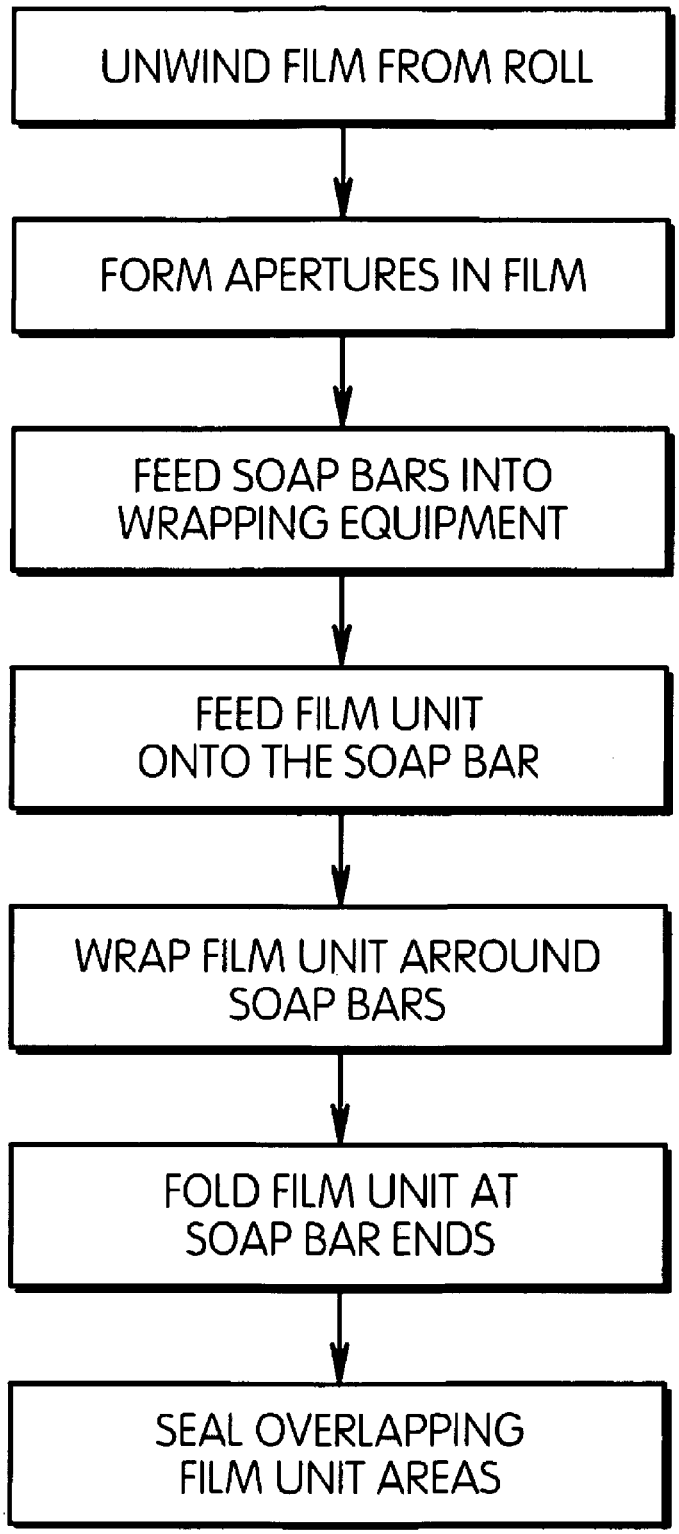
FIG. 1 is a schematic of a process for wrapping soap bars where film apertures are formed in-line with the wrapping.

FIG. 1 is a schematic diagram of one process for producing the film to wrap the present soap bars. The soap bars can be square, rectangular or generally rectangular where the edges and sides, ends, top and bottom surfaces are curved. The soap bar package can be comprised of a single wrapper film or there can be an inner stiffener sheet and an outer wrapper film. The present invention is directed primarily to the wrapper film material and to methods for the wrapper to emit some fragrance from a wrapped soap bar.

FIG. 1 is a schematic of a process starting with a unit of film on a roll which film has been printed and is ready to be registered with soap bars entering an automatic soap bar wrapping machine such as one available from Azionaria Costruzioni Machhine Automatiche ACMA S.p.A., Binacchi & C0. or Guerze Srl. These machines will wrap soap bars at speeds of from about 100 to about 400 soap bars per minute The film is unwound from the reel and is fed to an aperture forming station. Shaped apertures will be of a size in the diameter range of 0.1 mm to 10 mm, and preferably 0.2 mm to 8 mm. The total surface area of the shaped apertures for a wrapped soap bar will be about 50 sq. mm to about 1000 sq. mm, and preferably about 100 sq. mm to about 750 sq. mm. When the apertures are slits these will be in a combined overall length of about 10 mm to about 300 mm, and preferably about 30 mm to about 240 mm. The fragrance content of a soap bar usually is in the range of about 0.25% to about 4% by weight, and preferably about 0.5% to about 2% by weight. However, the fragrance content can exceed 4% by weight. Such a soap bar should retain at least about 40% to about 90% of the original fragrance content, and preferably at least about 50% to about 80% six months after the time of packaging which is at the time of manufacturing. Further a soap bar will contain about 12% to about 20% moisture, and preferably about 14% to about 18%. Such a soap bar should retain at least about 50%, and preferably at least about 60% of the original moisture content six months after the time of packaging. This allows for some fragrance and some moisture to be emitted through the soap bar wrapper film. However, the amount of fragrance and moisture that is emitted over a given period of time must be controlled so that the soap bar can contain a sufficient amount of fragrance and moisture at the time of use to satisfy the user.

The apertures in the film can be made using several different techniques. These include the preferred techniques of mechanically, thermally and optically forming the apertures. Mechanically formed apertures are punched in the film through the use of a die and anvil arrangement, and optically through the use of a laser device. In forming the apertures using a laser it has been found that some of the plastic removed to form the aperture makes a ring around the aperture and reinforces the periphery of the aperture.

At the same time, soap bars that have been produced on a soap bar production line, are conveyed to the soap bar wrapping machine. The unit of film, in the form of a strip of film, is fed into the soap bar wrapping machine. Typically it is laid over the soap bar with the leading edge tucked under the soap bar. Essentially simultaneously the segment to wrap that soap bar is cut from the unit of film material. The film trailing edge is tucked under the soap bar and overlaps the front edge. At the same time the ends are folded over and sealed. The overlapping front and trailing edges below the soap bar are also sealed at this time.

In the in-line of embodiment of FIG. 1 the film which usually has been printed is unwound from the storage reel and indexed at the station for forming apertures in the film. In the indexing operation the apertures are aligned with the printing on the film, which can include designs. The apertures are formed in the film material at the aperture forming station and the film material is then fed onto a soap bar in the wrapping machine. The film material is cut to length and wrapped laterally around the soap bar by tucking the front leading edge under the soap bar and then tucking the following rear edge under the soap bar and overlapping the leading edge. The sides of the film material are folded over the longitudinal sides of the soap bar and sealed and substantially simultaneously the overlapping front and rear edges are sealed.

Figure 2:
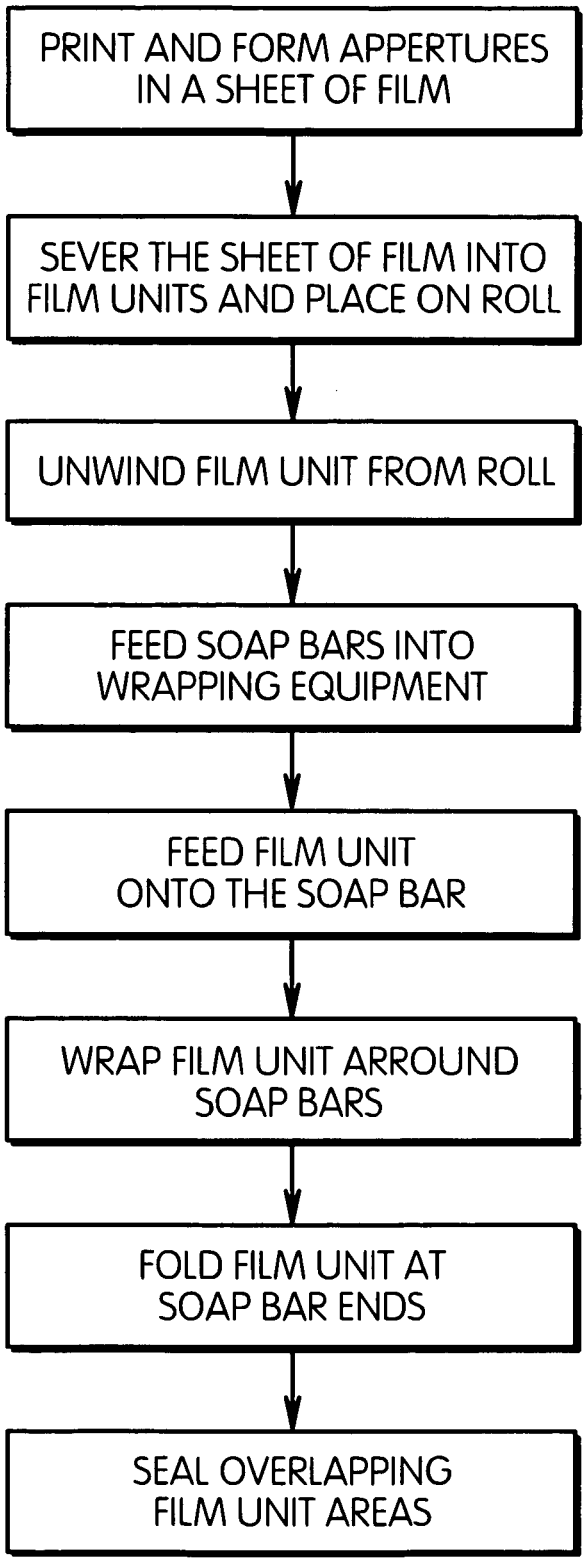
FIG. 2 is a schematic of a process for wrapping soap bars where film material aperture are formed off-line with the sheet of film material printing and wrapping.

FIG. 2 shows in a schematic diagram of the process where the apertures are made off-line. The apertures can be made to a wide sheet of film material while it is being printed, or the apertures can be made in the film prior to or after printing. The film material used to wrap a soap bar is about 10 cm to about 25 cm wide depending on the width of the soap bar. However the wrapper film is printed in wide sheets from about 50 cm to about 200 cm wide or more. These wide sheets will be about 5 to about 10 soap bar wrapper widths of film material wide. The film after printing and the forming of apertures is cut into units of film material and placed on rolls. The apertures also can be made at this time when the film material is being placed onto the rolls. Each unit of film material is a width sufficient to package a soap bar. These rolls then are set to be fed to aperture forming and soap bar wrapping as is set out in the schematic diagram of FIG. 2.

The schematic of FIG. 2 sets out one off-line process for producing a film material with apertures and subsequently wrapping this film around the soap bar. In this process a wide sheet of film material of from about 50 cm to about 200 cm is printed and the apertures formed in the film material. The apertures can be formed simultaneously with the printing operation, or just prior to or subsequent to the printing operation. The resulting sheet of film then is slit into individual strips each with a width needed to wrap a particular soap bar. Each of these individual strips is wound onto a reel and set aside for use later in wrapping soap bars. At the time of use a roll of the film is placed on the soap bar wrapping machine and fed onto soap bars that are also fed into the soap bar wrapping machine. The subsequent process steps are the same as the last five steps set out in the schematic for the on-line process of FIG. 1 and discussed above.

Figure 3:
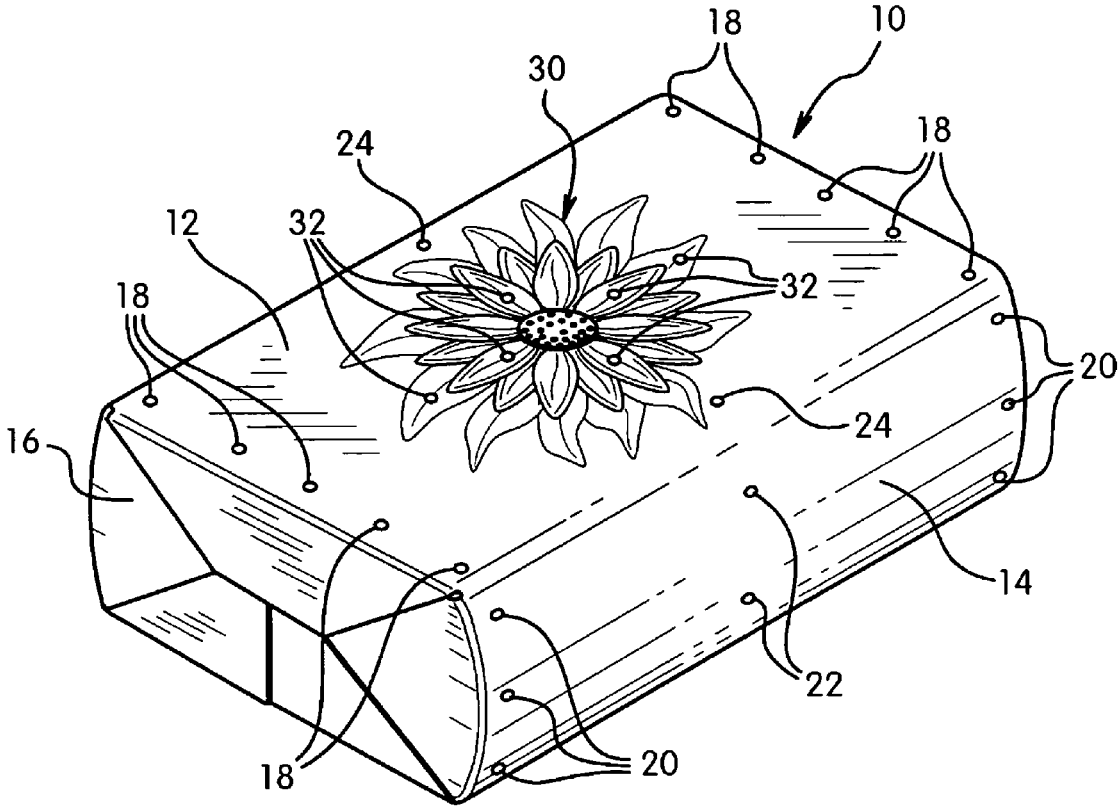
FIG. 3 is a perspective view of the soap bar with shaped opening apertures in the film wrapping.
Figure 4:
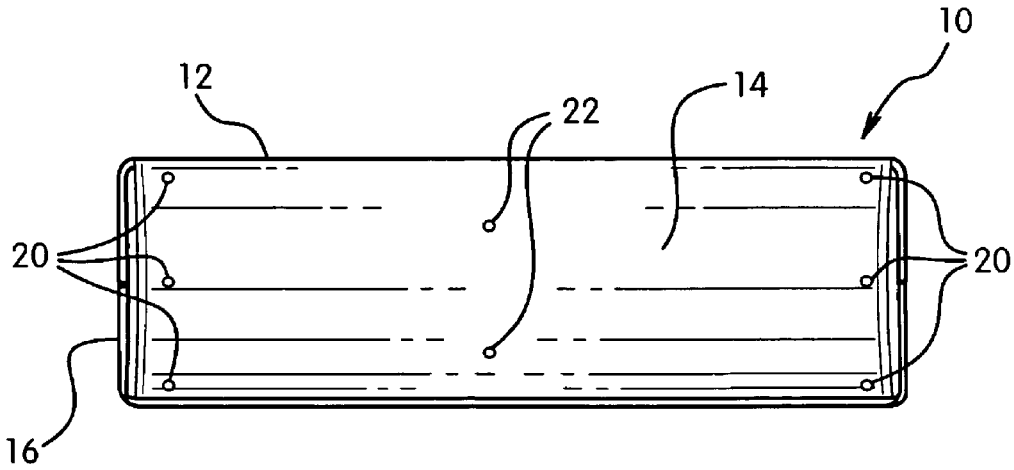
FIG. 4 is a side elevation view of the soap bar of FIG. 3.

FIGS. 3 and 4 show a packaged soap bar with a soap bar wrapper with apertures that are of a given number and size to emit a given amount of fragrance. In FIG. 3 the packaged soap bar is shown in a top perspective view. Some of the apertures are in the flower design while others are in different parts of the wrapper surface. The designs on the exterior of a wrapper will in many instances relate to the soap bar fragrance. A lily flower will be on a package where the soap bar fragrance is that of a lily. Likewise a rose floral display on the wrapper will be on a package where the soap bar fragrance is that of a rose. In such cases at least some of the apertures should be in the flower. All of the apertures can be in the flower or other decoration. The combination of the flower plus the fragrance of that particular flower will enhance the pleasant perception of the soap bar.

In more detail in FIGS. 3 and 4 there is shown wrapped soap bar 10. In FIG. 3 there is shown top surface 12, a side surface 14 and an end seal surface 16 of the wrapped soap bar. Adjacent each lateral edge of the top surface are apertures 18. Adjacent a longitudinal edge are apertures 24. In the center of the top surface is a flower 30 with apertures 32 in parts of the flower. The side surface 14 has lateral edge apertures 20 and other apertures 22. The end surface 16 is formed by material from the top, bottom and side surfaces being folded in an overlapping arrangement. This is a typical end surface for a wrapped soap bar. The side and end surfaces that are not shown will have the same structures. FIG. 4 shows the side surface in more detail.

Figure 5:
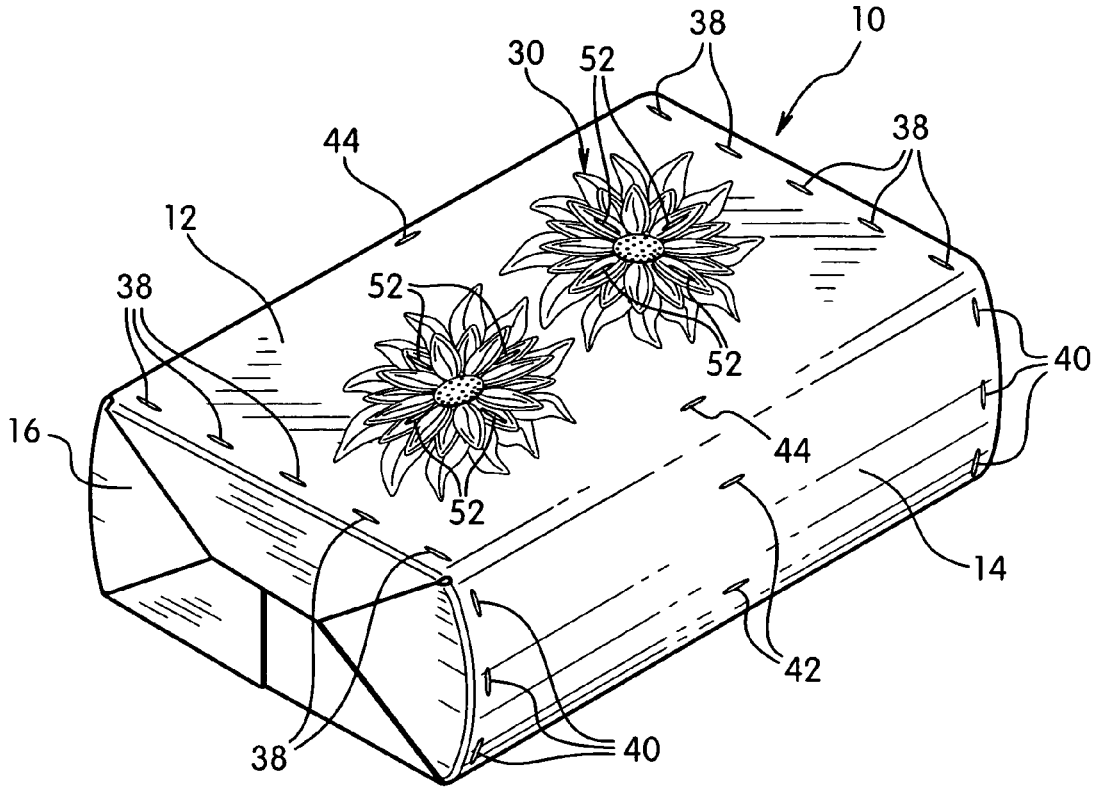
FIG. 5 is a perspective view of the soap bar with slit apertures in the film wrapping.
Figure 6:
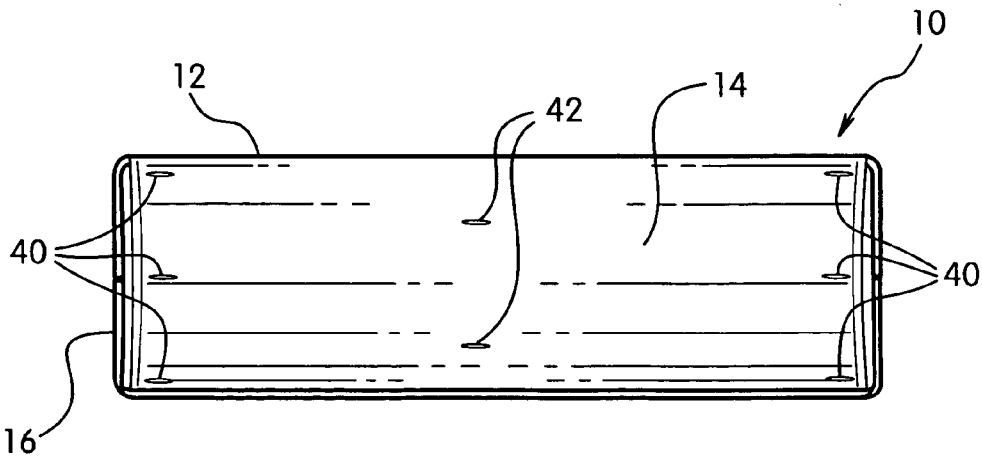
FIG. 6 is a side elevation view of the soap bar of FIG. 5.

FIGS. 5 and 6 show a soap bar with slit apertures in place of formed shape apertures. Here wrapped soap bar 10 has top surface 12 and longitudinal side surface 14. Also seen in FIG. 5 is end surface 16. In the top surface there are slits 38 along the lateral edges and longitudinal slits 44. In the top surface also there are flowers 30 with slit apertures 52. Side surface 14 has lateral edge slits 40 and additional slits 42. FIG. 6 shows the side surface 14 in more detail.

In addition in order to enhance the delivery of the soap bar fragrance there can be a coating of the fragrance on the inner surface of the wrapper film. Further, if an inner insert material, such as a paperboard, or plastic film, such as to be used as a stiffener, is used, this insert material can contain some of the soap bar fragrance in addition to, or in place of, the fragrance on the inner surface of the wrapper films. The carrier for the fragrance will be a polymer, or blends of polymers, such as polyethylene, polypropylene, or polyvinylchloride. Commercially available fragrances and polymeric fragrance carriers are available from International Flavors and Fragrances under the POLYIFF® product line. Further, just prior to packaging the soap bar can be over-sprayed with the fragrance of the soap bar to enhance the delivery of some fragrance from the wrapped soap bar.

Figure 7:
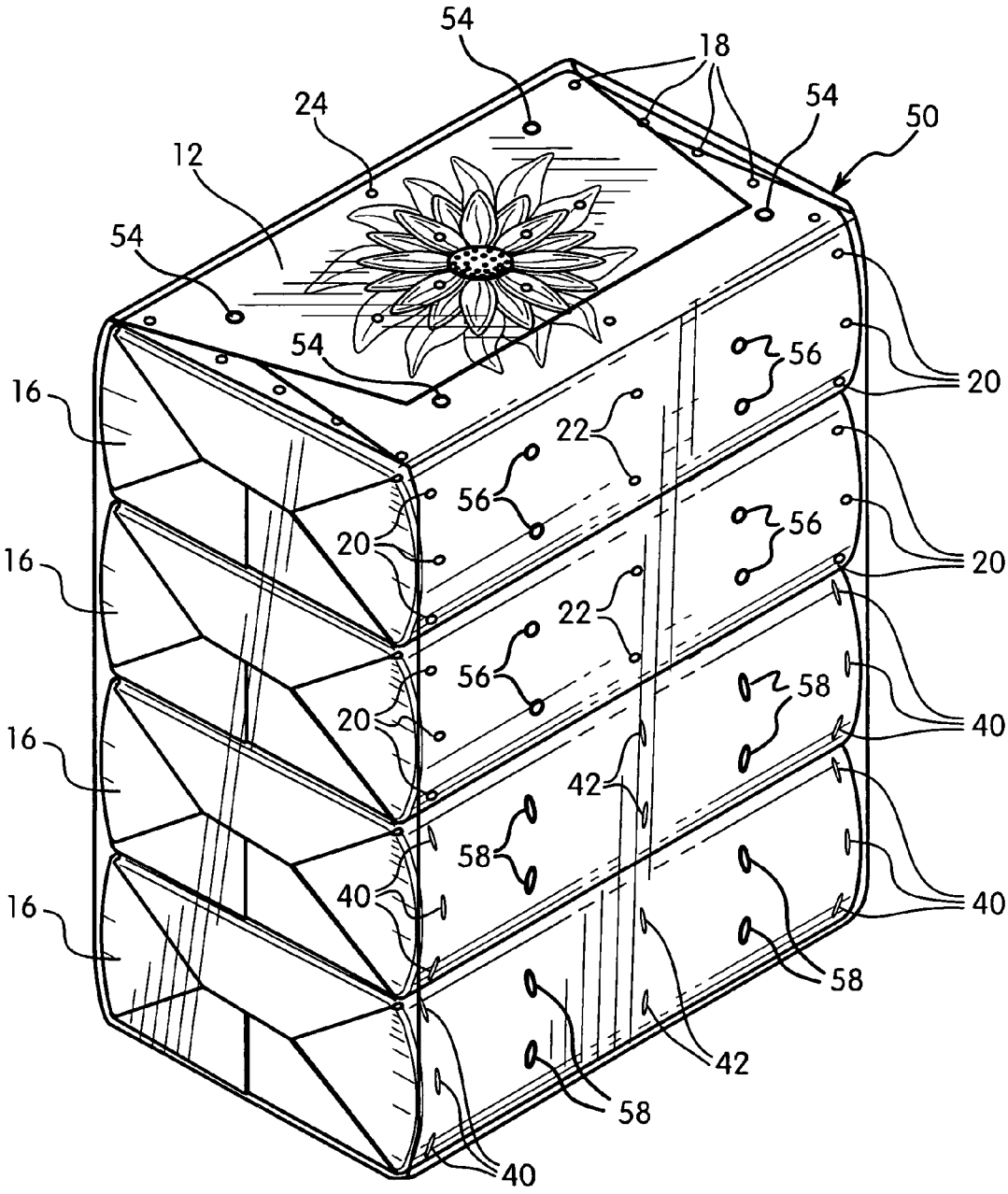
FIG. 7 is a perspective view of a multi-pack soap bar package.

In addition when a plurality of soap bars are packaged into a multi-pack the multi-pack package should likewise have apertures to assure that the fragrance the is emitted from the individual packaged soap bars can be detected outside of the multi-pack package. The film material of the multi-pack will have the same aperture characteristics as the film material of the soap bar packages. These can be shaped apertures or slit apertures. FIG. 7 shows a bundle pack 50 with four packaged soap bars, two FIG. 3 soap bars and two FIG. 5 soap bars. There are shaped apertures 54 on the top surface and shaped apertures 56 on the side surface. In addition there are slit apertures 58 on a lower part of the multi-pack.

The wrapper film material will have a thickness of about 25 micron to about 100 micron, and preferably about 50 microns to about 75 microns. Essentially any thermoplastic film, and laminates, thereof can be used as the wrapper film. These include polyethylene, polypropylene, polyvinylchloride, polystyrene and polyethylene teraphthalate. Further they can be coated with materials to enhance the properties of the film and to enhance the functional performance during the packaging process and in distribution.

Example

Palmolive Aroma soap bars were placed in closed collection vessels with a 500 cc. head space and equilibrated for two hours. Tenax adsorption tubes were fitted to the side ports of the vessels and a charcoal trap was fitted to the port on the vessel lids. From each vessel 200 cc. of head space was collected at 50 cc/min.

The procedure was carried out in triplicate using a fresh soap bar, packaged or no package. The soap bars were (a) no package; (b) packaged with 12 slit apertures 5 mm per slit aperture; (c) packaged with 12 shaped apertures 25 sq. mm. each; and (d) packaged with no apertures. The package was a 76 micron biaxially oriented polypropylene film material sealed at each end and across the longitudinal bottom seal.

The Tenax traps were desorbed on a Gerstal TDS System to an Agilent 6890 gas chromatograph with a Kratos Concept mass spectrometry detector. The Gerstal System was operated at a standby temperature of 50 C and a transfer temperature of 325 C. The valve temperature was 20 C. The first rate was 60 C/min. with a final temperature of 260 C and a final time of 5 minutes. The Agilent 6890 used a CIS Inlet System at a pressure of 15.59 psi., flow rate of 2.0 ml/min and an average velocity of 30 cm/sec. The gas type was helium. The purge flow was 99.4 ml/min. a purge time of 1 minute and a purge flow of 104.4 ml/min. The gas chromatograph column was an HP 19091Z-115 (50 m length and 0.32 mm ID, and film thickness of 0.52 micron) operated at an initial temperature of 75 C with a first rate of 2 C/min, a first final temperature of 250 C. and first final time of 12.50 min. The run time was 100 min. The FID detector was at 310 C with a hydrogen flow of 40 ml/min and an air flow of 450 ml/min.

The gas chromatograph results consisting of the area under the adsorption curve was as follows:

(a) soap bar—no package—129,298
(b) package with slit apertures—31,656
(c) package with shaped apertures—48,744
(d) package—no apertures—14,487

In a panel test for the perception by individuals the fragrance intensity was evaluated on a scale of 1 to 7 with 1 being without the perception of any fragrance and 7 being a very strong perception of a fragrance. The samples were aged for 2, 4, 6, 8, 10, and 12 weeks. Soap bars (b) above were rated a 3 level for the first 4 weeks and a 4 level for the remaining 8 weeks. Soap bars (c) were rated a 5 level for all 12 weeks. The soap bars (d) were rated a 1 level for the first 4 weeks and a 2 level for the remaining 8 weeks. The results relate well with the gas chromatographic data.

The invention claimed is:

1. A method of packaging a soap bar to provide fragrance transmission from the package comprising the in-line steps of providing a supply source of a film material having a botanical plant decoration printed thereon; continually removing said film material from said supply source and forming a plurality of apertures in said film material within the botanical plant decoration; continually conveying said film material with apertures into contact with a fragrance containing soap bar and wrapping said film material with apertures laterally around the soap bar; and sealing overlapping edges of said film material wrapped around the soap bar to form a packaged soap bar with transmission of said fragrance from the package, the fragrance of said soap bar being substantially the same as that emitted by a botanical plant represented by said botanical plant decoration, and wherein prior to contact with said film material said soap bar is over-sprayed with the fragrance of said soap bar.

2. A method as in claim 1 wherein the botanical plant decoration is in at least one surface of the film material wrapped around the soap bar.

3. A method as in claim 1 wherein the botanical plant decoration is in at least one of a top surface, a side surface, and a bottom surface of the film material wrapped around the soap bar.

4. A method as in claim 1 wherein the apertures are shaped apertures, the surface area of the shaped apertures have a surface area of about 50 sq. mm to about 1000 sq. mm.

5. A method as in claim 1 wherein the apertures are slits, the overall length of the slits for the wrapped soap bar being about 10 mm to about 300 mm.

6. A method as in claim 1 wherein the apertures are of a size to emit less than 60 percent of the fragrance content of said soap bar and less than 50 percent of the moisture content of said soap bar within a period of 6 months.

7. A method of packaging a soap bar having a fragrance to provide fragrance transmission from the package comprising the in-line steps of providing a supply source of a film material having a botanical plant decoration printed thereon; continually removing said film material from said supply source and forming a plurality of apertures in said film material at a predetermined location on said film material, coating said film material on at least the surface to be adjacent the soap bar when wrapped around the soap bar with a coating of the fragrance substantially the same as that contained in said soap bar, continually conveying said film material with apertures into contact with the fragrance containing soap bar and wrapping said film material with apertures laterally around the soap bar; and sealing overlapping edges of said film material wrapped around the soap bar to form a packaged soap bar with transmission of said fragrance from the package, the fragrance of said soap bar being substantially the same as that emitted by a botanical plant the same as said botanical plant decoration.

8. A method as in claim 7 wherein the botanical plant decoration is in at least one of a top surface, a bottom surface or a side surface of the film material wrapped around the soap bar.

9. A method as in claim 8 wherein the botanical plant decoration is in a top surface of the film material.

10. A method as in claim 7 wherein the apertures are of a size to emit less than 60 percent of the fragrance content of said soap bar and less than 50 percent of the moisture content of said soap bar within a period of 6 months.

11. A method as in claim 7 wherein prior to contact with said film material said soap bar is over-sprayed with the fragrance of said soap bar.

12. A method as in claim 7 wherein the apertures are in the botanical plant decoration.

13. A method of packaging a soap bar having a fragrance to provide fragrance transmission from the package comprising the in-line steps of providing, a supply source of a film material having a botanical plant decoration printed thereon and a supply source for an inner stiffener material, continually removing said film material and inner stiffener material from each supply source and forming a plurality of apertures in said film material at a predetermined location on said film material, coating said inner stiffener material on at least the surface to be adjacent the soap bar when wrapped around the soap bar with a coating of the fragrance substantially the same as that contained in said soap bar, continually conveying said film material with apertures into contact with the fragrance containing soap bar and wrapping said film material with apertures laterally around the soap bar; and sealing overlapping edges of said film material wrapped around the soap bar to form a packaged soap bar with transmission of said fragrance from the package, the fragrance of said soap bar being substantially the same as that emitted by a botanical plant the same as said botanical plant decoration.

14. A method as in claim 13 wherein the plant decoration is in at least one of a top surface, a bottom surface or a side surface of the film material wrapped around the soap bar.

15. A method as in claim 14 wherein the botanical plant decoration is in a top surface of the film material.

16. A method as in claim 13 wherein the apertures are of a size to emit less than 60 percent of the fragrance content of said soap bar and less than 50 percent of the moisture content of said soap bar within a period of 6 months.

17. A method as in claim 13 wherein prior to contact with said film material said soap bar is over-sprayed with the fragrance of said soap bar.

18. A method as in claim 13 wherein the apertures are in the botanical plant decoration.

* * * * *